United States Patent [19]

Bauer et al.

[11] Patent Number: 4,786,212

[45] Date of Patent: Nov. 22, 1988

[54] PROCESS AND APPARATUS FOR REINFORCING A PREDETERMINABLE AREA IN THE GROUND

[75] Inventors: Karlheinz Bauer; Manfred Stocker, both of Schrobenhausen; Franz X. Abt, Mindelheim, all of Fed. Rep. of Germany

[73] Assignee: Karl Bauer Spezialtiefbau GmbH & Co, KG, Schrobenhausen, Fed. Rep. of Germany

[21] Appl. No.: 35,454

[22] Filed: Apr. 7, 1987

Related U.S. Application Data

[63] Continuation-in-part of Ser. No. 860,816, May 8, 1986, abandoned.

[30] Foreign Application Priority Data

May 9, 1985 [DE] Fed. Rep. of Germany ..... 3516756

[51] Int. Cl.[4] ..... E02D 3/12

[52] U.S. Cl. ..... 405/269; 405/241; 405/263

[58] Field of Search ..... 405/269, 263, 241, 242, 405/233, 240, 248

[56] References Cited

U.S. PATENT DOCUMENTS

| | | | |
|---|---|---|---|
| 1,840,195 | 1/1932 | Hasse | 239/418 X |
| 1,852,903 | 4/1932 | Salmon | 405/248 |
| 2,584,178 | 2/1952 | Abbott et al. | 239/418 X |
| 3,335,956 | 8/1967 | James | 239/290 X |
| 3,707,848 | 1/1973 | Chelminski | 405/240 X |
| 3,786,639 | 1/1974 | Pineno et al. | 405/269 X |
| 4,116,368 | 9/1978 | Smith | 405/269 X |
| 4,308,996 | 1/1982 | Rotolico | 239/290 |
| 4,433,943 | 2/1984 | Pao Chen | 405/241 |
| 4,606,675 | 8/1986 | Mitani et al. | 405/269 X |
| 4,624,606 | 11/1986 | Nakanishi et al. | 405/269 |

FOREIGN PATENT DOCUMENTS

| | | | |
|---|---|---|---|
| 1164364 | 6/1985 | U.S.S.R. | 405/269 |

*Primary Examiner*—Dennis L. Taylor

*Attorney, Agent, or Firm*—Fleit, Jacobson, Cohn & Price

[57] ABSTRACT

Process and apparatus for consolidating, sealing and stabilizing a predeterminable area in the ground, particularly for making foundations, underpinnings or seals in a building site, by injecting at least one hardening liquid material in a high energy liquid jet into the ground, accompanied by the simultaneous injection of a gaseous material, characterized in that for the injection of the gaseous material, at least one discrete gas jet is formed and injected separately from the liquid jet and is located in the vicinity of the exit port of the liquid jet and guided at a distance from the liquid jet.

15 Claims, 6 Drawing Sheets

PROCESS AND APPARATUS FOR REINFORCING A PREDETERMINABLE AREA IN THE GROUND

This is a continuation-in-part application of U.S. Ser. No. 860,816, filed May 8, 1986, now abandoned.

BACKGROUND OF THE INVENTION

This invention relates to a process for consolidating, sealing and stabilizing a predeterminable area in the soil or ground, particularly for making foundations, underpinnings or seals in a building site, by injecting at least one liquid cement suspension material in at least one high energy liquid jet, accompanied by the simultaneous injection of gaseous material to force the liquid cement suspension material into the ground.

The invention further relates to an apparatus for performing the inventive process with an injection tube and a nozzle carrier arranged thereon with a liquid jet exit port and a gas jet exit port.

It has been found that a relatively high expenditure and technical effort are required in order to carry out an intermittent operation of the above type in a reliable manner under poor building site conditions. It has also been found that in the case of such an intermittent operation, the penetration of the high energy liquid jet into the ground is not satisfactory in many applications.

SUMMARY OF THE INVENTION

The present invention provides a process of the aforementioned type by using a particularly strong, simple, operationally safe and reliable construction characterized by limited fault-proneness. Superior liquid material penetration into the ground is permitted. The invention also provides an apparatus for performing such a process.

According to the invention, gaseous material is injected into the ground in at least one discrete gas jet which is separate from the liquid jet. The gas jet is guided in the same direction as and substantially parallel to the liquid jet and is spaced therefrom by approximately one to five liquid jet diameters.

The invention leads to a surprising and significant advance in the art. Despite the use of a very simple, light and compact apparatus as compared with known devices, it is possible to achieve liquid material penetrating ranges which far exceed those hitherto attainable and which could previously be obtained only with great technical effort and expenditure and without the same degree of reliability. The present invention allows discharged liquid material to penetrate even fine grained soil a distance of approximately 0.6 meters.

A particularly simple embodiment of the invention is obtained by providing both the gas jet and the liquid jet with a circular cross-section and providing the gas jet with a diameter which is of the same order of magnitude as the diameter of the liquid jet. The diameter of the gas jet preferably ranges anywhere approximately from 1 to 10 mm, while the diameter of the liquid jet preferably ranges approximately from 1 to 8 mm. It has been found that substantially the same advantageous result with respect to liquid material penetration into the ground can be obtained if the spacing between the two jets is slightly varied. The gas jet and the liquid jet can be spaced from one another anywhere from approximately one to five times the diameter of the liquid jet. The two jets can either be juxtaposed or superposed, without significant variations resulting from either arrangement.

According to another advantageous embodiment of the invention, several gas jets may be formed in closely juxtaposed manner. Independently of the number of gas jets used, the total gas jet cross-sectional area should always be kept constant.

When a liquid jet with a circular cross-section is present, the gas jet may be formed with an elongated cross-sectional shape, although the preferred gas jet cross-section is circular. For example, the gas jet may have a cross-section with the configuration of an elongated, narrow rectangle arranged in a radially symmetrical manner to the liquid jet, or the gas jet may be formed with a slightly curved, elongated, thin cross-section. The arrangement can advantageously be such that the gas jet is formed with a cross-sectional dimension larger than the diameter of the liquid jet; however, the cross-sectional area of the gas jet may range anywhere from approximately 0.5 to 4 times that of the liquid jet.

An apparatus for performing the inventive process is characterized in that separate from a liquid jet exit port there is at least one discrete gas jet exit port and the latter is spaced from the liquid jet exit port by a few diameters of the gas jet exit port. Such an apparatus can be manufactured very simply, and is also very strong and operationally reliable in use. With an apparatus according to the invention, good liquid material penetration results are still obtained if the size and/or the spacing of the two openings is changed. The two openings or ports can be juxtaposed, superposed or used in other spatial positions relative to one another without significantly influencing the liquid penetration into the ground.

It has been found that the inventive apparatus is not readily susceptible to wear. Even when a change to the nozzle surface in the opening region is brought about by wear and/or external influences, good liquid material penetration is not impaired. No particular significance is attached to the exact shape of the openings in the jet exit region, but the liquid and gas jet exit ports must be located in close proximity to one another to achieve the desired penetration of liquid material into the ground.

According to one embodiment of the inventive apparatus, the gas jet exit port and liquid jet exit port each have a circular cross-section and the diameter of the gas jet exit port and that of the liquid jet exit port are roughly the same. This leads to the further advantage that the two exit ports are interchangeable, so that good penetration results can still be obtained in case the liquid and air connections are confused and reversed. Several gas jet exit ports may be closely juxtaposed on the nozzle carrier. Two or an even larger number of gas jet exit ports can be used, as long as the total gas jet area is kept approximately constant and preferably within the range of 0.8 to 80 $mm^2$, independently of the number of gas jet exit ports used. Preferably, several gas jet exit ports are closely juxtaposed.

According to a further development of the invention, when a circular liquid jet exit port is used, the gas jet exit port may have a slot-like construction. The arrangement can be such that the gas jet exit port has a cross-section with the configuration of an elongated, narrow rectangle, arranged radially symmetrically to the liquid jet exit port, such that the gas jet exit port has the configuration of a slightly arcuately curved slot, or such that the longer cross-sectional dimension of the gas jet exit port is larger than the diameter of the liquid jet exit port.

The invention makes it possible with a simple equipment arrangement and in a limited space to bring about, in a substantially vibration-free and environmently non-prejudicial manner, ground or soil reinforcement and/or sealing by introducing cement suspensions into varied soil types. Thus, in the case of otherwise non-load-bearing soils, it is possible to erect buildings and subsequently underpin and stabilize the buildings, both for the reconstruction of a building and for the excavation of a foundation trench which must be located immediately adjacent to the foundation of a building.

DESCRIPTION OF THE PREFERRED EMBODIMENTS

Figure 1:
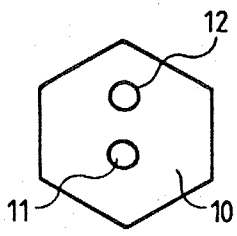
FIGS. 1–4 each illustrate a diagramatic front view of exemplary nozzle carrier embodiments according to the invention.

FIG. 1 diagrammatically shows a front view of nozzle carrier 10. Whereas the nozzle carrier 10 in FIG. 1 has a hexagonal configuration, said nozzle carrier could have any other desired geometrical configuration and can, for example, be round.

In order to simplify the representation, the liquid feed lines and the gas feed lines are not shown in FIGS. 1–4. All that is shown in FIGS. 1–4 are examples of advantageous exit port configurations as regards their shape, size and relative positioning.

Figure 2:
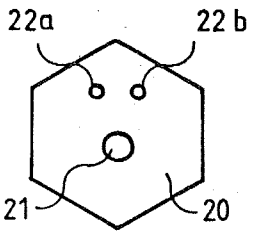
Figure 3:
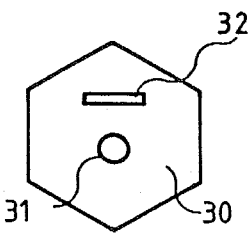
Figure 4:
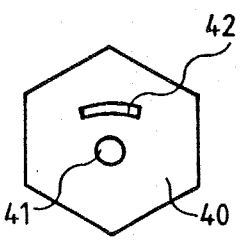

According to FIG. 1, a liquid jet exit port 11 in the form of a bore is provided, which has a diameter of a few millimeters. FIG. 1 also illustrates gas jet exit port 12 facing in the same direction as exit port 11. FIGS. 2, 3 and 4 in each case show a liquid jet exit port in the form of a bore 21, 31 or 41, although it is also possible to use other cross-sectional shapes for the liquid jet exit port.

In order to unify the representation, FIGS. 2, 3 and 4 in each case show a nozzle carrier 20, 30 or 40 similar in construction to nozzle carrier 10 and with a hexagonal configuration. However, it is clear that independently of the shape and position of the exit ports, the nozzle carrier can be circular or square or can have any other desired geometrical configuration.

According to FIG. 2, there are two gas jet exit ports **22*a*, 22*b* adjacent to the liquid jet exit port 21. However, further gas jet exit ports could be provided, which would then preferably all be arranged in the zone defined by the two gas jet exit ports 22*a*, 22*b***.

According to FIG. 3, a slot-like gas jet exit port 32 is positioned at a distance from the liquid jet exit port 31. The slot-like gas jet exit port has a cross-section corresponding to an elongated, narrow rectangle.

According to FIG. 4, at a distance from and adjacent to the liquid jet exit port 41 is provided a gas jet exit port 42 which is in the form of a slightly arcuately curved slot.

If it is made certain that the total opening cross-sections of the different gas jet exit ports, as shown in FIGS. 1–4, are in each case the same, no significant variations in operating results occur. However, the ratio between the cross-sectional surface of the liquid jet exit port and the gas jet exit port could be varied, without leading to significant variations in the operating results, if the respective operating pressures of the liquid and the gas, and therefore their exit velocities are varied accordingly.

Figure 5:
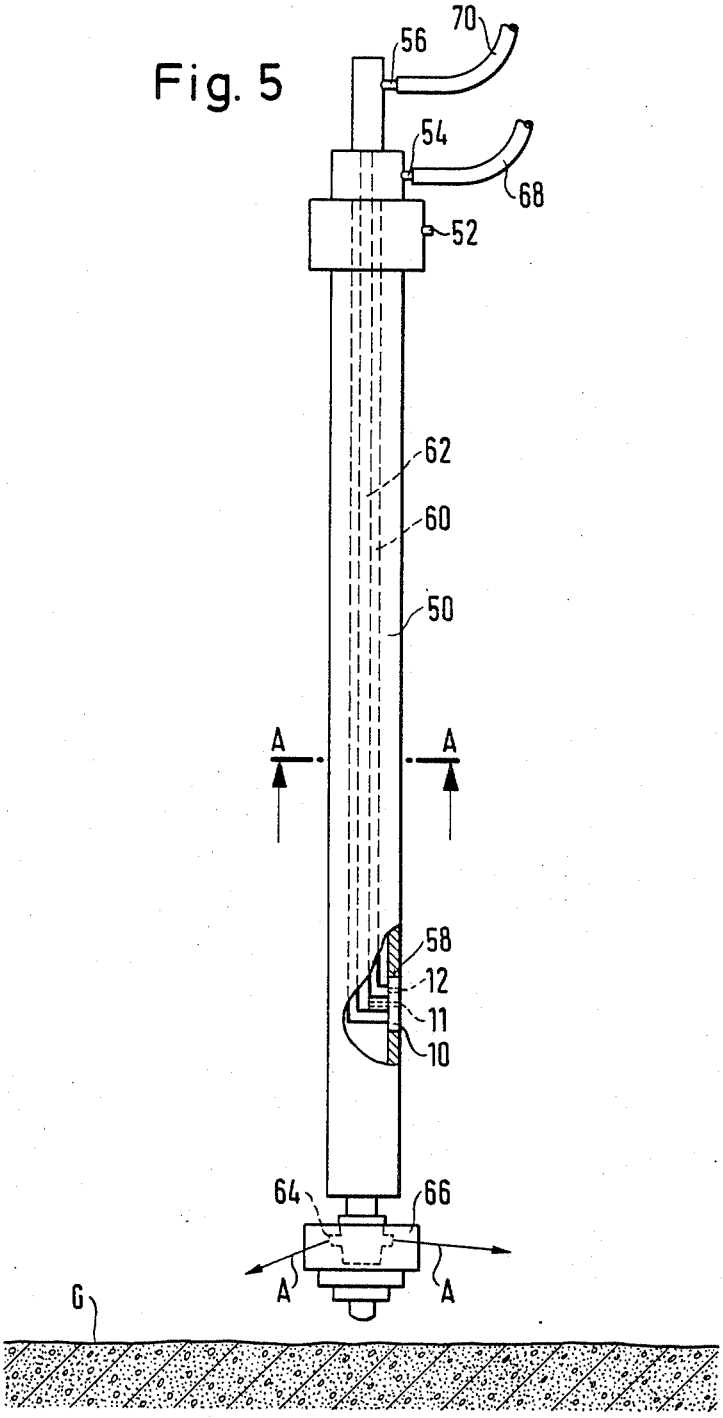
FIG. 5 is a schematic illustration of an injection tube or rod in which the nozzle carriers illustrated in FIGS. 1–4 may be used.
Figure 6:
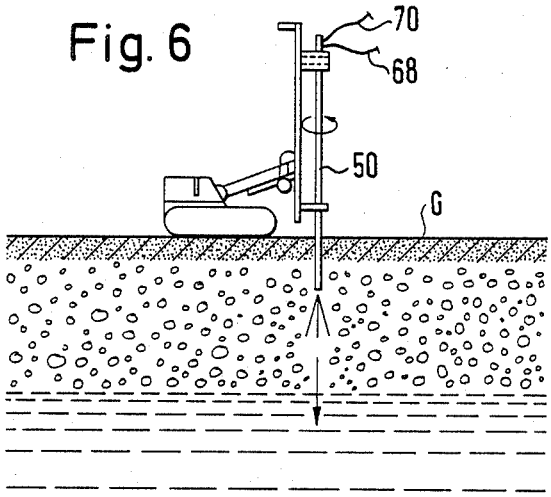
FIGS. 6–9 illustrate the process of the instant invention for stabilizing an area in the ground.
Figure 11:
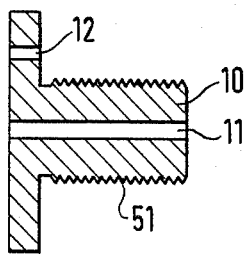
FIG. 11 is a side sectional view of the nozzle carrier of FIG. 1.
Figure 12:
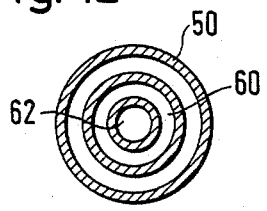
FIG. 12 is a sectional view of the injection rod of FIG. 5 taken along the plane defined by line A—A therein.
Figure 13:
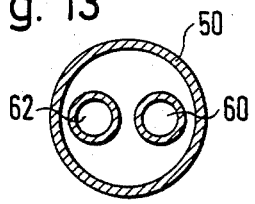
FIG. 13 is a sectional view of an alternative injection rod construction.

In FIG. 5 there is illustrated an injection tube or rod in which the nozzle carriers illustrated in FIGS. 1–4 may interchangeably be used. The injection rod is schematically illustrated and is indicated generally by reference numeral 50. Injection rod 50 includes at its upper end a flush medium inlet 52, a compressed gas inlet 54 and a high pressure liquid inlet 56. Near the lower end of injection rod 50 is a recess 58. Nozzle carrier 10 is illustrated in its installed position within recess 58. As illustrated in FIG. 11, a cylindrical outer surface of nozzle carrier 10 is provided with external threads 59 which are received in cooperating internal threads formed in a passageway 62. Alternatively, nozzle carrier 10 may be held in recess 58 by screws or in any other conventional manner. While only one such recess 58 is illustrated in the preferred embodiment of FIG. 5, it should be noted that a plurality of recesses and nozzle carriers could be distributed about the circumference of injection rod 50 to facilitate distribution of liquid about the circumference of the injection rod. Gas supplied to compressed gas inlet 54 is carried via passageway 60 to the gas jet exit port 12, while a liquid cement suspension supplied to high pressure liquid inlet 56 is carried via passageway 62 to liquid jet exit port 11. The passageways 60 and 62 may be formed from concentric tubes, as shown in FIGS. 5 and 12, or alternatively from two parallel tubes as illustrated in FIG. 13.

The process for consolidating or sealing an area in the ground G is illustrated in FIGS. 6, 7, 8 and 9. This process is comprised of a drilling phase and an injection phase. In the drilling phase illustrated in FIG. 6, injection rod 50 is rotated by any method known in the art and forced downwardly by hydraulic cylinders, chains or other known feed means into the ground G. As injection rod 50 is rotated and forced downwardly, a flush medium, such as water, is supplied to inlet 52 by a hose or the like and is carried through the body of injection rod 50 to flush medium outlet 64 located within bore crown 66. The flush medium supplied to the outlet 64 passes through bore crown 66, as indicated by arrows A, and into the ground to flush sand and soil away from bore crown 66.

Figure 7:
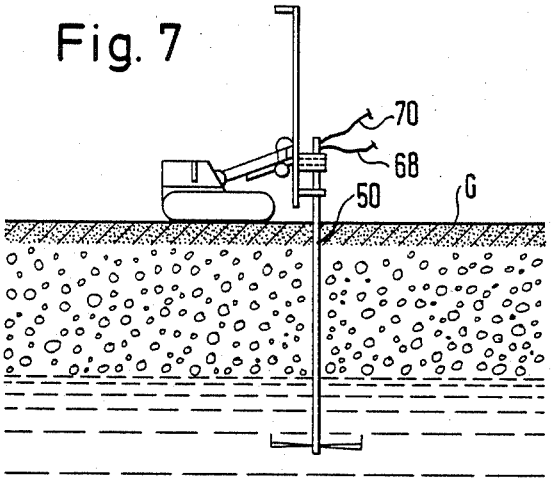
Figure 8:
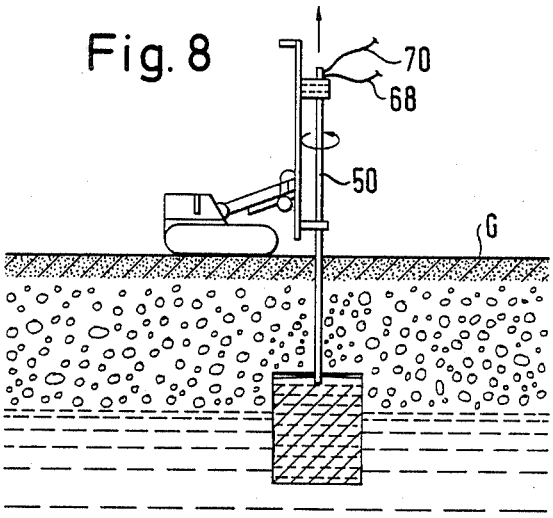
Figure 9:
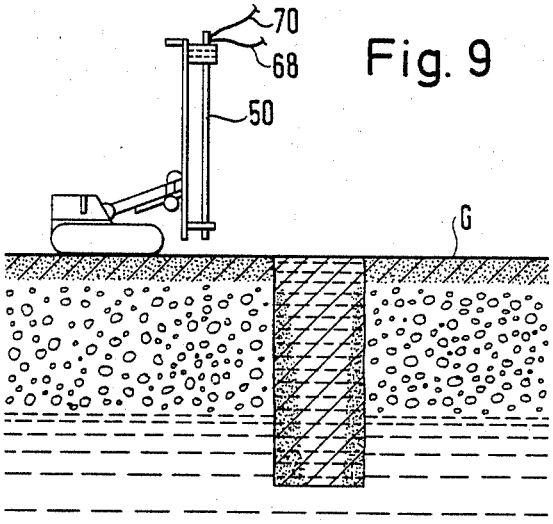

Once injection rod 50 has been forced downwardly into the ground to its final depth, the drilling phase has been completed. The injection phase then begins as shown in FIG. 7. The supply of flush medium to flush medium inlet 52 is discontinued. Compressed gas is supplied to inlet 54 via hose 68 while, simultaneously, a liquid cement suspension is supplied to inlet 56 under high pressure via hose 70. As is clearly apparent from FIGS. 5–9, the supply of flush medium to inlet 52 is discontinued the supply of gas and liquid to inlets 54 and 56 is initiated by valve means which form no part of the instant invention. The liquid cement suspension is discharged in a liquid jet radially relative to injection rod 50 from exit port 11 at a high velocity and is forced by compressed gas discharged in the same direction radially relative to the injection rod in a gas jet from exit port 12 to penetrate the ground in the discharge direction of the liquid jet and the gas jet. The injection rod 50 is rotated and withdrawn upwardly from the ground G as illustrated in FIG. 8, thereby forming a column of discharged liquid cement in the ground. A completed column of discharged liquid cement is illustrated in FIG. 9. After the cement hardens, it acts to stabilize, consolidate and seal the ground, rendering it more suitable for the construction of foundations and the like.

Figure 10:
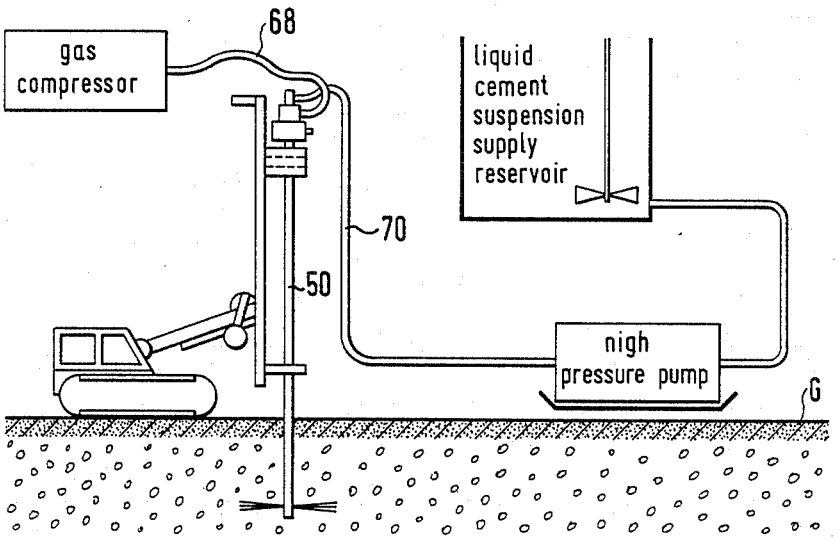
FIG. 10 illustrates components used in conjunction with the injection tube or rod during its injection phase.

FIG. 10 illustrates schematically the components used to supply compressed gas and the liquid cement suspension to inlets 54 and 56 during the injection phase. A high pressure pump supplies the liquid cement suspension from a reservoir to the injection rod 50 via hose 70. At the same time, compressed gas is supplied to injection rod 50 via hose 68 from a gas compressor.

The use of nozzle carrier configurations such as those described above and illustrated by way of example in FIGS. 1-4 in conjunction with the injection rod 50 makes it possible to force penetration by the liquid cement suspension material into the ground to a degree which greatly exceeds the penetration previously possible. This superior penetration is achieved by the use of an exceptionally strong and simple nozzle and injection rod construction.

While the present invention has been disclosed in connection with preferred embodiments thereof, it should be understood that other embodiments may fall within the spirit and scope of the invention as defined by the following claims.

What is claimed is:

1. A process for reinforcing, stabilizing, consolidating and sealing a predeterminable area in the ground comprising the steps of providing an injection rod;

providing a nozzle carrier having a liquid jet exit port and at least one gas jet exit port oriented radially relative to said injection rod;

rotating said injection rod and forcing said injection rod downwardly so that said injection rod penetrates the ground;

supplying a flush medium to said injection rod so that soil is flushed away from said injection rod as it is rotated and forced downwardly;

discontinuing the supply of flush medium to said injection rod once said injection rod has been forced downwardly into the ground to its final depth;

injecting a liquid material through said liquid jet exit port in a liquid jet into the ground radially relative to said injection rod in a rotatable discharge direction;

simultaneously injecting a discrete jet of gaseous material through said at least one gas jet exit port into the ground, said jet of gaseous material separated from said liquid jet;

guiding said jet of gaseous material radially relative to said injection rod and parallel to said liquid jet in said rotatable discharge direction so that said jet of gaseous material forces said liquid material to penetrate the ground;

rotating and withdrawing said injection rod from within the ground such that said rotatable discharge direction rotates and forms a column of discharged liquid material in the ground, the liquid material subsequently solidifying to stabilize, consolidate and seal the ground.

2. A process according to claim 1, wherein both the jet of gaseous material and the liquid jet have circular cross-sections and the diameter of the jet of gaseous material is of the same order of magnitude as the diameter of the liquid jet.

3. A process according to claim 1, wherein several discrete jets of gaseous material are formed in a closely juxtaposed manner.

4. A process according to claim 1, wherein the liquid jet has a circular cross-section and the jet of gaseous material has an elongated, thin cross-section.

5. A process according to claim 4, wherein the jet of gaseous material is formed with a narrow, rectangular cross-section superposed the liquid jet.

6. A process according to claim 4, wherein the jet of gaseous material is formed with a cross-section which is slightly curved.

7. A process according to claim 4, wherein the jet of gaseous material is formed with a cross-section larger than the diameter of the liquid jet.

8. A process for reinforcing, stabilizing, consolidating and sealing a predeterminable area in the ground comprising the steps of:

(a) forcing an injection rod into the ground in a drilling phase;

(b) subsequently injecting a liquid material from said injection rod in at least one liquid jet into the ground in a discharge direction in an injection phase;

(c) simultaneously injecting a discrete jet of gaseous material from said injection rod into the ground, said jet of gaseous material separated from said liquid jet;

(d) guiding said jet of gaseous material parallel to said liquid jet and in said discharge direction so that said jet of gaseous material forces said liquid material to penetrate the ground; and (e) rotating and withdrawing said injection rod from within the ground such that said discharge direction rotates and forms a column of discharged liquid material in the ground, the liquid material subsequently solidifying to stabilize, consolidate and seal the ground.

9. An apparatus for reinforcing, stabilizing, consolidating and sealing a predeterminable area in the ground comprising:

an injection rod;

a nozzle carrier installed on said injection rod, said nozzle carrier including a liquid jet exit port and a gas jet exit port;

means for injecting a liquid cement material in at least one liquid jet into the ground from said injection rod in a discharge direction through said liquid jet exit port and for simultaneously injecting a discrete jet of gaseous material into the ground from said injection rod through said gas jet exit port;

said gas jet exit port and said liquid jet exit port guiding said jet of gaseous material parallel to said liquid jet and in said discharge direction so that said jet of gaseous material forces said liquid cement material to penetrate the ground in said discharge direction;

means for rotating and withdrawing said injection rod from within the ground such that said discharge direction rotates and forms a column of discharged liquid cement material which subsequently solidifies to stabilize, consolidate and seal the ground.

10. An apparatus according to claim 9, wherein the gas jet exit port and liquid jet exit port have circular cross-sections and the diameters of the gas jet exit port and liquid jet exit port are approximately the same.

11. An apparatus according to claim 9, wherein several gas jet exit ports are juxtaposed on said nozzle carrier.

12. An apparatus according to claim 9, wherein said liquid jet exit port has a circular cross-section and said gas jet exit port has a slot-like construction.

13. An apparatus according to claim 12, wherein said gas jet exit port has an elongated, narrow rectangular cross-section superposed the liquid jet exit port.

14. An apparatus according to claim 12, wherein said gas jet exit port has an arcuately curved cross-section.

15. An apparatus according to claim 12, wherein said gas jet exit port has a cross-sectional dimension larger than the diameter of said liquid jet exit port.

* * * * *